US008632116B2

(12) United States Patent
Mette et al.

(10) Patent No.: US 8,632,116 B2
(45) Date of Patent: Jan. 21, 2014

(54) ANTI-THEFT DEVICE FOR AN ACCESS DOOR

(75) Inventors: Richard K. Mette, Shelby Township, MI (US); Teru Tseng, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 298 days.

(21) Appl. No.: 12/871,996

(22) Filed: Aug. 31, 2010

(65) Prior Publication Data

US 2012/0049578 A1 Mar. 1, 2012

(51) Int. Cl.
*B60J 5/04* (2006.01)
*E05B 65/00* (2006.01)

(52) U.S. Cl.
USPC ..... 296/146.9; 296/202; 292/216; 70/91

(58) Field of Classification Search
USPC ..... 296/146.9, 202; 292/1, DIG. 65, 216; 70/91, 208, 370, 451, 466
See application file for complete search history.

(56) References Cited

U.S. PATENT DOCUMENTS 6,415,636 B1 7/2002 Fukumoto et al.
6,604,393 B2 8/2003 Larsen et al.
6,748,775 B1 * 6/2004 Bucker et al. ..... 70/208
7,146,832 B2 * 12/2006 Mathofer ..... 70/208
2011/0187156 A1 * 8/2011 Granny et al. ..... 296/202

FOREIGN PATENT DOCUMENTS

CN 1542248 A 11/2004
DE 10254047 A1 6/2004

* cited by examiner

*Primary Examiner* — Glenn Dayoan
*Assistant Examiner* — Melissa A Black
(74) *Attorney, Agent, or Firm* — Quinn Law Group, PLLC

(57) ABSTRACT

A door includes an exterior-facing surface, an inner structure, and a latch mechanism. The door also includes a key-cylinder attached to and accessible from the exterior-facing surface, and adapted to selectively lock and unlock the latch mechanism, and a pawl adapted to be rotated by the key-cylinder to unlock the latch mechanism. Furthermore, the door includes a feature arranged on the inner structure and aligned with the key-cylinder, and a component connected to the key-cylinder, aligned with and extending into the feature without contacting the inner structure. The component is configured to not impede the rotation of the pawl when the component is aligned with the feature. Additionally, the component is configured to restrict angular movement of the key-cylinder with respect to the door, when the key-cylinder is forcibly manipulated thereby causing the component to contact the inner structure.

16 Claims, 3 Drawing Sheets

ANTI-THEFT DEVICE FOR AN ACCESS DOOR

TECHNICAL FIELD

The invention relates to an anti-theft device for an access door.

BACKGROUND

A typical vehicle has at least one access door. Such a door typically has a latch mechanism for maintaining the door in a locked state until access into or egress from the vehicle is required. The latch mechanism is typically actuated by an outside door handle to gain access to the interior of the vehicle.

Vehicles are sometimes subject to unauthorized entry and theft. To prevent such unauthorized entry while permitting authorized access, on at least some vehicle doors the latch mechanism is provided with an externally actuated lock having a key-lock cylinder. Attempts to gain unauthorized entry into the vehicle may include triggering the door latch mechanism by forcibly manipulating the key-lock cylinder with respect to the door.

SUMMARY

A door is provided for an entryway. The door includes an exterior-facing surface and an inner structure. The door also includes a latch mechanism connected to the inner structure, configured to be fastened such that the door maintains closure of the entryway, and capable of being released such that the door opens the entryway. The door also includes a key-cylinder attached to and accessible from the exterior-facing surface, and adapted to selectively lock and unlock the latch mechanism. Additionally, the door includes a pawl attached to the key-cylinder and operatively connected to the latch mechanism, such that the pawl is rotated by the key-cylinder to unlock the latch mechanism. Furthermore, the door includes a feature arranged on the inner structure and aligned with the key-cylinder, and a component connected to the key-cylinder, the component being aligned with and extending into the feature without contacting the inner structure. The component is configured to not impede the rotation of the pawl by the key-cylinder when the component is aligned with the feature. Additionally, the component is configured to restrict angular movement of the key-cylinder with respect to the door, when the key-cylinder is forcibly manipulated thereby causing the component to contact the inner structure.

The component may be configured as a stud. Such a stud may include a cap that hooks onto the inner structure and limits extraction of the stud from the feature when the key-cylinder is forcibly manipulated. The above stud may be a metal fastener, and, in such a case, the fastener may be threaded into the key-cylinder.

The inner structure may include a glass-run channel and the feature may be fashioned as a cavity in the glass-run channel, and be configured to trap the component. The glass-run channel may be formed from a plastic material, and the cavity may be molded into the glass-run channel. The above cavity may include a reinforced edge.

The door may further include a rod, and, in such a case, the pawl may be connected to the latch mechanism via the rod. The door may also include a door handle, wherein the door handle is attached to the bracket, and the key-cylinder is housed in, and protrudes through the door handle.

The above described door may be employed to facilitate ingress and egress in a vehicle.

The above features and advantages and other features and advantages of the present invention are readily apparent from the following detailed description of the best modes for carrying out the invention when taken in connection with the accompanying drawings.

DETAILED DESCRIPTION

Figure 1:
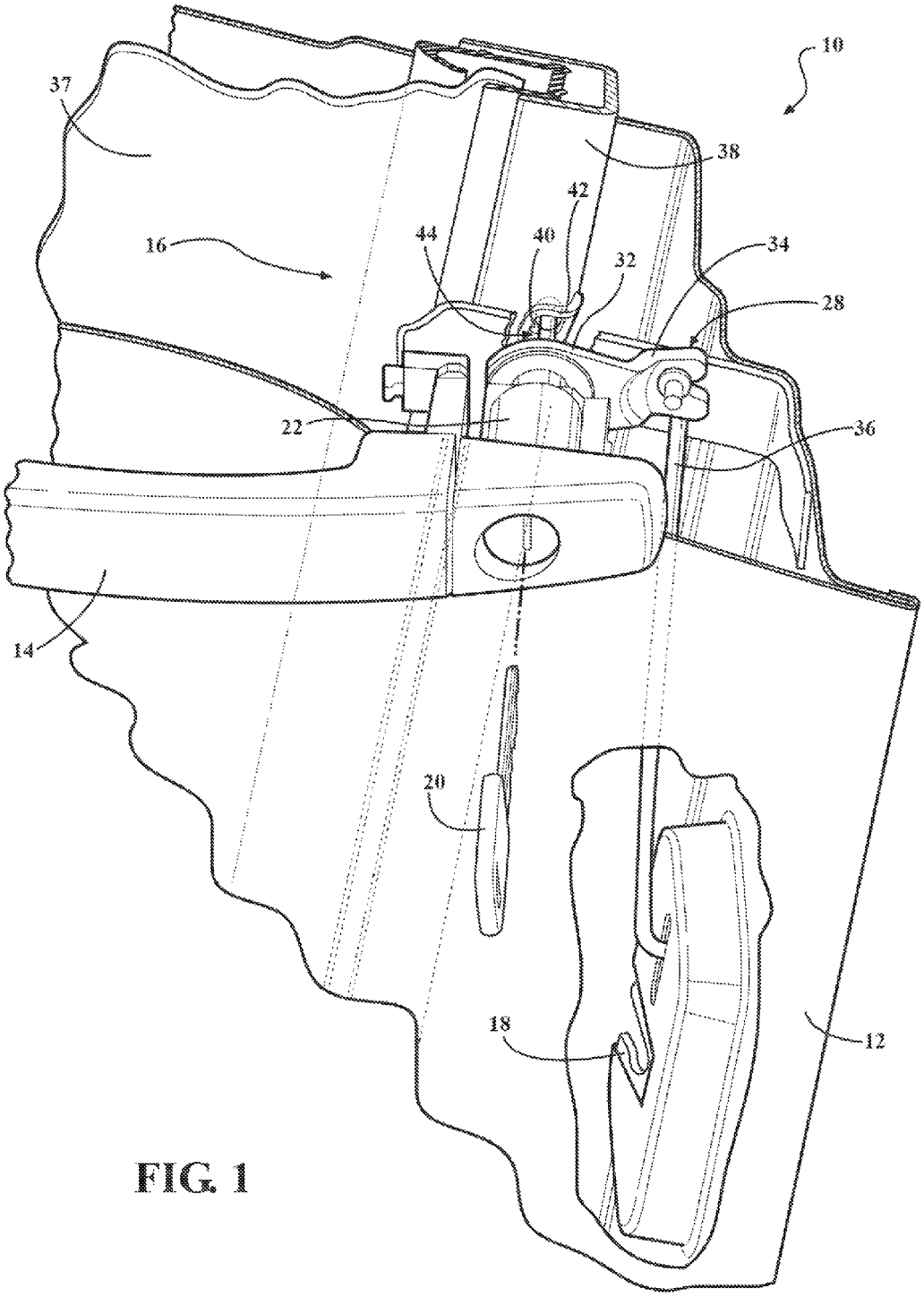
FIG. 1 is a perspective exploded view of a portion of a vehicle door illustrating an anti-theft device according to an embodiment.
Figure 2:
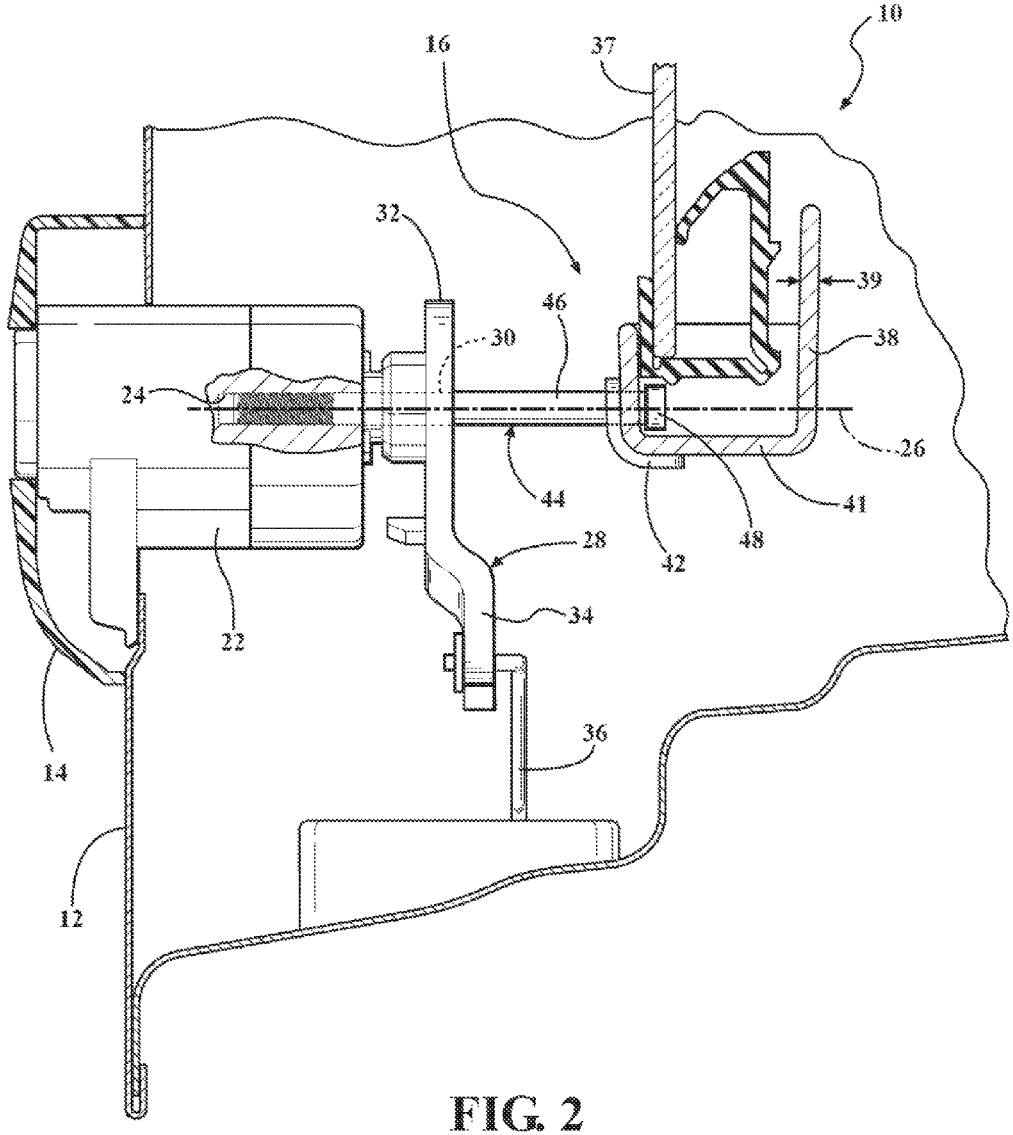
FIG. 2 is a cut-away view of the assembled vehicle door having the anti-theft device shown in FIG. 1.

Referring to the drawings, wherein like reference numbers refer to like components, FIGS. 1 and 2 show a vehicle door 10. The door 10 includes an exterior-facing surface 12. Exterior-facing surface 12 includes an exterior door-release handle 14. The door 10 also includes an inner structure 16. The inner structure 16 may have a unitary configuration, or a combination of interconnected brackets and/or mounting members that may be formed from any suitable materials such as steel, aluminum or plastic. Inner structure 16 is configured to support, among other items, exterior surface 12, a latch mechanism 18, and various wiring and other door hardware, such as for electrical locking, as known by those skilled in the art.

The latch mechanism 18 is configured to be released via exterior door-release handle 14, as well as via an interior door-release handle (not shown). Latch mechanism 18 is typically connected to the inner structure 16 via suitable fasteners, as known by those skilled in the art, and is configured to be fastened, such that door 10 maintains closure of an entryway into the vehicle, and is capable of being released by door-release handle 14 to permit the door to open the entryway. Exterior door-release handle 14 is connected to the exterior-facing surface 12. Although not shown, a bracket is typically provided within inner structure 16 to support the door-release handle 14.

A key-cylinder 22, i.e., key-lock cylinder, is located on the door 10, such that the key-cylinder is accessible from the exterior-facing surface 12. As shown in FIG. 2, key-cylinder 22 includes a threaded aperture 24, which is centered on and disposed along axis 26. Key-cylinder 22 is adapted to selectively lock and unlock latch mechanism 18 by rotating a pawl 28. Key-cylinder 22 is configured to be activated by an operator looking to gain access to the vehicle via a key 20 specifically adapted for the particular key-cylinder. Key-cylinder 22 is tamper-resistant, i.e., resistant to being jimmied open and turned to unlock latch 18 without the proper key 20.

The pawl 28 is attached to the key-cylinder 22. Pawl 28 is manufactured from a suitable rigid material, such as steel, and includes an aperture 30. Pawl 28 is shown as having a substantially rounded part 32 with an extended arm 34, wherein the aperture 30 is disposed substantially in the center of the rounded part of the pawl. The connection between pawl 28 and key-cylinder 22 is such that the key-cylinder is capable of rotating with respect to the exterior door-release handle 14 around axis 26 which extends through the center of aperture 30. Pawl 28 is operatively connected to latch mechanism 18 via a rod 36 for selectively locking and unlocking the latch. Rod 36 is disposed off axis 26, such that when pawl 28 is turned or rotated, the rod is translated with respect to latch mechanism 18 in order to selectively lock and unlock the latch mechanism.

A glass-run channel 38 is included as part of inner structure 16. Glass-run channel 38 is a rigid structure specifically designed to guide a glass panel 37 inside the door 10, while the glass panel is either raised or lowered on demand by an occupant of the vehicle. Glass-run channel 38 may be incorporated into inner structure 16 by any suitable means such as welding or fastening with screws, in part depending on the base material of the glass-run channel. Glass-run channel 38 is formed from a material having suitable rigidity and toughness, such as a plastic or a metal, for supporting the glass panel either in its open or closed states inside the door 10. Glass-run channel 38 is characterized by a thickness 39 that provides the structural support required for retention and guidance of the glass panel.

As best seen in FIG. 1, the glass-run channel 38 includes a feature 40, shown as a slot or a cavity. In the presented embodiment, feature 40 is shown to penetrate through the thickness 39 and wrap around an outer edge 41 of the glass-run channel 38. Although shown as a slot or a cavity wrapping around the outer edge 41, the shape and placement of the feature 40 on the glass-run channel 38 depends on the configuration and positioning of the glass-run channel within inner structure 16. When glass-run channel 38 is incorporated into inner structure 16, feature 40 is centered on axis 26 as permitted by the design and build tolerances of tooling used to assemble the door 10. Feature 40 is shown as including a reinforced edge 42 that is defined by a raised frame. Reinforced edge 42 is employed to additionally strengthen feature 40, and to facilitate retention of the feature's shape under load. Feature 40 may be either stamped or molded into glass-run channel 38, depending on the base material chosen for the glass-run channel. Feature 40 may also be included in any sufficiently rigid component that is part of the inner structure 16.

A component 44, shown as a threaded stud, is connected to key-cylinder 22, and is aligned with and extends through aperture 30. In place of the shown stud, the component 44 may be a specially formed, rigid component 44 such as a capped threaded metal fastener e.g., if such is necessitated by packaging or other concerns. Component 44 includes a body 46 and may include a cap 48, as shown in FIG. 2. Feature 40 is characterized by dimensions, such as a width and a height, sufficient to permit the body 46 of component 44 to be inserted into the feature without physically contacting the reinforced edge 42.

During assembly of the component 44 with the key-cylinder 22, the component is initially inserted through the aperture 30 into pawl 28 and then into the key-cylinder, thereby positioning body 46 to extend toward and into feature 40. When the door 10 is fully assembled, as a result of the extension of component 44 into feature 40, the component becomes trapped by the slot or cavity feature whenever the key-cylinder 22 is forcibly manipulated in a way to attempt triggering latch mechanism 18. As noted above, feature 40 is incorporated into glass-run channel 38 which is designed to be sufficiently rigid and tough in order to withstand significant loads while supporting and guiding the glass panel. Therefore, feature 40 offers suitable resistance and restriction to angular movement of component 44 in case of forced manipulation of key-cylinder 22.

Cap 48 may be incorporated into component 44 in order to hook onto the glass-run channel 38, such as to prevent the component from slipping out of feature 40 in case of forced angular manipulation of key-cylinder 22. Thus installed, by extending through the aperture 30 and into the feature 40, component 44 does not physically contact the reinforced edge 42 during normal operation of key-cylinder 22. Component 44 is thus configured to rotate together with key-cylinder 22 when the key 20 is turned to lock or unlock the latch mechanism 18, without impeding regular action of the key-cylinder in any way.

Figure 3:
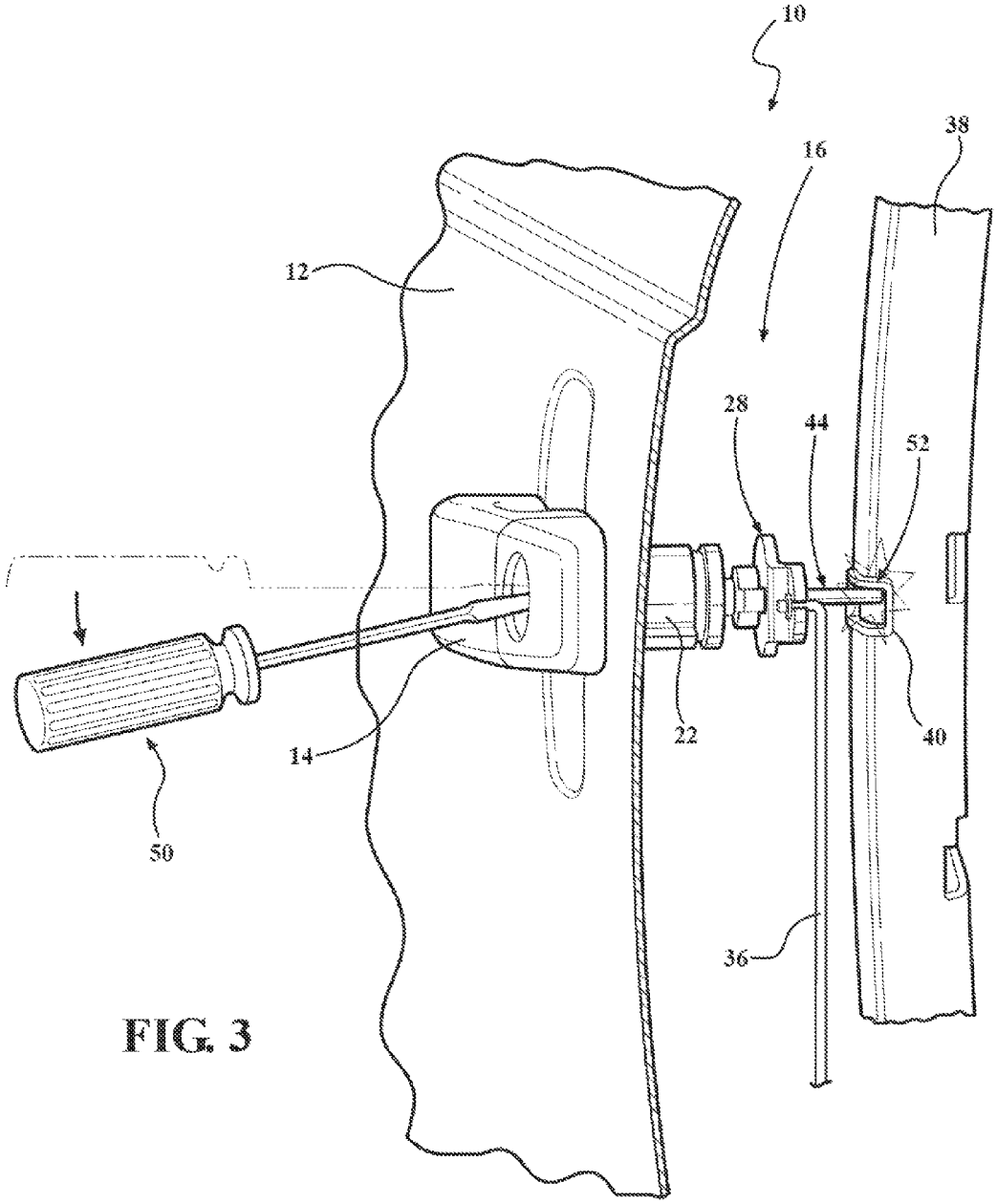
FIG. 3 is a close-up perspective view of the portion of the vehicle door shown in FIG. 1, illustrating a forcibly manipulated key-cylinder resulting in the anti-theft device limiting/preventing the triggering of a latch mechanism to thereby unlock the door.

Although component 44 does not restrict normal operation of key-cylinder 30, the stud does operate to counteract forcible manipulation of the key-cylinder with the intent to gain unauthorized entry into the vehicle. In such a situation, it may be attempted to insert an implement, such as a screwdriver 50 (shown in FIG. 3), into key-cylinder 22 to exert a force and shift the entire key-cylinder in order to displace the rod 36 and unlock the latch mechanism 18. During such forcible manipulation, the entire exterior-facing surface 12 may be flexed in an attempt to trigger the latch mechanism 18. Upon such manipulation, however, component 44 will contact the reinforced edge 42 of feature 40, thus restricting movement of key-cylinder 22 independent of glass-run channel 38, and reducing the likelihood of a successful forced triggering of latch mechanism 18. Contact 52 between reinforced edge 42 of feature 40 and body 46 and/or cap 48 of component 44 upon the above-described forcible manipulation is depicted in FIG. 3.

While the best modes for carrying out the invention have been described in detail, those familiar with the art to which this invention relates will recognize various alternative designs and embodiments for practicing the invention within the scope of the appended claims.

The invention claimed is:

1. A door for closure of an entryway, the door comprising:
an exterior-facing surface;
an inner structure;
a latch mechanism connected to the inner structure, configured to be fastened such that the door maintains closure of the entryway, and capable of being released such that the door opens the entryway;
a key-cylinder attached to and accessible from the exterior-facing surface, and adapted to selectively lock and unlock the latch mechanism;
a pawl attached to the key-cylinder and operatively connected to the latch mechanism, such that the pawl is rotated by the key-cylinder to unlock the latch mechanism;
a feature arranged on the inner structure and aligned with the key-cylinder; and
a rigid stud connected to the key-cylinder and extending through the pawl, the stud being aligned with and extending into the feature without contacting the inner structure;
wherein the stud is configured to not impede the rotation of the pawl when the stud is aligned with the feature, and configured to restrict angular movement of the key-cylinder with respect to the door when the key-cylinder is forcibly manipulated, thereby causing the stud to contact the inner structure.

2. The door of claim 1, wherein the stud includes a cap that hooks onto the inner structure and limits extraction of the stud from the feature when the key-cylinder is forcibly manipulated.

3. The door of claim 1, wherein the stud is a metal fastener threaded into the key-cylinder.

4. The door of claim 1, wherein the inner structure includes a glass-run channel and the feature is a cavity in the glass-run channel configured to trap the stud.

5. The door of claim 4, wherein the glass-run channel is formed from a plastic material, and the cavity is molded into the glass-run channel.

6. The door of claim 4, wherein the cavity includes a reinforced edge.

7. The door of claim 1, further comprising a rod, wherein the pawl is connected to the latch mechanism via the rod.

8. The door of claim 1, further comprising a door handle, wherein the door handle is attached to the exterior-facing surface, and the key-cylinder is housed in the door handle.

9. A vehicle comprising:

an entryway; and a door for the entryway, the door having:

an exterior-facing surface;

an inner structure;

a latch mechanism connected to the inner structure, the latch mechanism being fastenable such that the door maintains closure of the entryway, and releasable such that the door opens the entryway;

a key-cylinder attached to and accessible from the exterior-facing surface, and adapted to selectively lock and unlock the latch mechanism;

a pawl attached to the key-cylinder and operatively connected to the latch mechanism, such that the pawl is rotated by the key-cylinder to unlock the latch mechanism;

a feature arranged on the inner structure and aligned with the key-cylinder; and a rigid stud connected to the key-cylinder and extending through the pawl, the stud being aligned with and extending into the feature without contacting the inner structure;

wherein the stud is configured to not impede the rotation of the pawl by the key-cylinder when the stud is aligned with the feature, and is further configured to restrict angular movement of the key-cylinder with respect to the door, when the key-cylinder is forcibly manipulated, thereby causing the stud to contact the inner structure.

10. The vehicle of claim 9, wherein the stud includes a cap that hooks onto the inner structure and limits extraction of the stud from the feature when the key-cylinder is forcibly manipulated.

11. The vehicle of claim 9, wherein the stud is a metal fastener threaded into the key-cylinder.

12. The vehicle of claim 9, wherein the inner structure includes a glass-run channel and the feature is a cavity in the glass-run channel configured to trap the stud.

13. The vehicle of claim 12, wherein the glass-run channel is formed from a plastic material, and the cavity is molded into the glass-run channel.

14. The vehicle of claim 12, wherein the cavity includes a reinforced edge.

15. The vehicle of claim 9, further comprising a rod, and the pawl is connected to the latch mechanism via the rod.

16. The vehicle of claim 9, further comprising a door handle, wherein the door handle is attached to the exterior-facing surface, and the key-cylinder is housed in the door handle.

* * * * *